United States Patent [19]

Szucs et al.

[11] Patent Number: 4,648,443

[45] Date of Patent: Mar. 10, 1987

[54] HEAT EXCHANGER WITH RIBBED FIN

[75] Inventors: László Szucs; József Szabó; Csaba Tasnádi, all of Budapest, Hungary

[73] Assignee: Energiagazdalkodasi Intezet, Budapest, Hungary

[21] Appl. No.: 815,755

[22] PCT Filed: Feb. 2, 1982

[86] PCT No.: PCT/HU82/00002

§ 371 Date: Oct. 21, 1982

§ 102(e) Date: Oct. 21, 1982

[87] PCT Pub. No.: WO82/02763

PCT Pub. Date: Aug. 19, 1982

Related U.S. Application Data

[63] Continuation of Ser. No. 438,859, Oct. 21, 1982, abandoned.

[30] Foreign Application Priority Data

Feb. 6, 1981 [HU] Hungary ..... 292/81

[51] Int. Cl.[4] ..... F28F 1/30

[52] U.S. Cl. ..... 165/181; 165/183

[58] Field of Search ..... 165/181, 182, 183

[56] References Cited

U.S. PATENT DOCUMENTS

| | | | |
|---|---|---|---|
| 1,970,105 | 8/1934 | Smith | 165/181 X |
| 2,655,352 | 10/1953 | Dalin | 165/183 X |
| 2,716,802 | 9/1955 | Greer | 165/181 |
| 2,903,245 | 9/1959 | Kritzer | 165/181 |
| 2,948,054 | 8/1960 | Kritzer | 165/181 |
| 2,959,402 | 11/1960 | Edwards | 165/182 |
| 2,965,555 | 12/1960 | Hall . | |
| 3,106,958 | 10/1963 | Simpelaar | 165/181 |
| 3,343,596 | 9/1967 | Kritzer | 165/183 X |
| 3,490,524 | 1/1970 | Pasternak | 165/181 |
| 3,672,446 | 6/1972 | Tibbetts et al. | 165/183 |
| 3,804,159 | 4/1974 | Searight et al. | 165/181 |
| 3,867,981 | 2/1975 | Monroe . | |
| 3,916,989 | 11/1975 | Harada et al. . | |
| 4,107,394 | 8/1978 | Almen . | |

FOREIGN PATENT DOCUMENTS

| | | | |
|---|---|---|---|
| 180276 | 12/1954 | Austria . | |
| 499498 | 3/1951 | Belgium . | |
| 0005959 | 3/1982 | European Pat. Off. . | |
| 532310 | 8/1931 | Fed. Rep. of Germany . | |
| 866348 | 2/1953 | Fed. Rep. of Germany | 165/183 |
| 1051880 | 2/1956 | Fed. Rep. of Germany . | |
| 1129170 | 9/1957 | Fed. Rep. of Germany . | |

List Continued on next page.

*Primary Examiner*—William R. Cline
*Assistant Examiner*—John K. Ford
*Attorney, Agent, or Firm*—Karl F. Ross; Herbert Dubno

[57] ABSTRACT

The invention is, on the one hand, a heat exchanger comprising at least one tube (1) and at least one ribbing made of a heat conducting material folded to a concertina-like shape, where the ribbing has ribs (2), each of them being substantially perpendicular to the axis (10) of the tube (1) and comprising wings (4A, 4B) and a rib base (3) between them, and where the ribs (2) are attached to the tube (1) at their rib base (3). At least one of said wings (4A, 4B) of each ribs (2) comprises patterns interrupting the continuity of the wing material, and/or bent surfaces making an acute angle ($\alpha$) to a plane perpendicular to the axis (10) of the tube (1). The patterns may be cutouts (7A, 7B), holes (8), outpressed parts (9) or embossings (17A, 17B). The invention is, on the other hand, a method of making a heat exchanger comprising forming ribs (2) by folding a strip of a heat conducting material to a concertina-like shape and attaching the ribs (2) of the folded material to a tube (1) transversally, where before the folding cutouts (7A, 7B), holes (8) and/or outpressed parts (9) are formed on parts of the strip corresponding to the ribs (2), and/or after having attached the ribs (2) to the tube (1) at least a part of the surface of the ribs (2) is bent as compared to a plane perpendicular to the axis (10) of said tube (1).

9 Claims, 15 Drawing Figures

FOREIGN PATENT DOCUMENTS

| | | | |
|---|---|---|---|
| 2123722 | 11/1972 | Fed. Rep. of Germany . | |
| 2415656 | 10/1975 | Fed. Rep. of Germany . | |
| 2728472 | 11/1979 | Fed. Rep. of Germany . | |
| 3025835 | 1/1981 | Fed. Rep. of Germany . | |
| 533288 | 3/1973 | France . | |
| 2235343 | 11/1975 | France | 165/183 |
| 55406 | 4/1921 | Sweden | 165/183 |
| 119503 | 8/1940 | Sweden . | |
| 414705 | 6/1966 | Switzerland . | |
| 532237 | 12/1972 | Switzerland . | |
| 531155 | 1/1973 | Switzerland . | |
| 570748 | 12/1975 | Switzerland | 165/183 |
| 1099687 | 1/1968 | United Kingdom . | |
| 1466656 | 3/1977 | United Kingdom . | |
| 177912 | 1/1966 | U.S.S.R. . | |
| 188998 | 12/1966 | U.S.S.R. . | |
| 458276 | 11/1976 | U.S.S.R. . | |

HEAT EXCHANGER WITH RIBBED FIN

This is a continuation of co-pending application Ser. No. 438,858 filed on Oct. 21, 1982, now abandoned.

FIELD OF THE INVENTION

The subject matter of the invention is a heat exchanger comprising at least one tube and at least one ribbing made of a heat conducting material folded to a concertina-like shape, where the ribbing folds have ribs, each of them being substantially perpendicular to the axis of the tube and comprising wings and a rib base between them, and where the ribs are attached to the tube at their rib base.

BACKGROUND OF THE INVENTION

There is a known heat exchanger comprising a tube and a wire ribbing attached to it, in which the wire after expedient deformation is folded to a concertina-like shape, and then attached to the mantle of the tube along one of its generatrices by a permanent joint, e.g. welding or soldering. Such a heat exchanger is described in the Hungarian Pat. No. 153,573.

A lamellar cooling ribbing is known furthermore from the Hungarian Pat. No. 144,706, where a metal strip folded in a zigzag shape is inserted between two cooling tubes, and where the metal strip constitutes the cooling ribbing.

In both of the above mentioned devices the ribs are of a continuous material and their surfaces stand in the direction of flow of the medium streaming at a right angle to the tube axis. Heat exchangers of this type have the advantage that their production can easily be automated, and that they can be produced in a welded construction as well, i.e. they can be used even in cases of high temperature.

OBJECT OF THE INVENTION

The object of the present invention is to provide a novel heat exchanger of the aforedescribed type with improved heat engineering characteristics without making its production essentially more complicated or expensive.

SUMMARY OF THE INVENTION

The invention is based on the discovery that patterns interrupting the continuity of the material (e.g. discontinuities such as cutouts, outpressed parts or embossings) applied on parts of the folded heat conducting material (e.g. metal strip) constituting the ribs and/or bends result in an essential improvement of the heat-transfer characteristics of the heat exchanger. In order to make these patterns or bendings only an insignificant enlargement or modification of the production line producing ribbed heat exchangers is needed.

Thus the invention is a heat exchanger comprising at least one tube and at least one ribbing made of a heat conducting material folded to a concertina-like shape, where said ribbing has ribs each of them being substantially perpendicular to the axis of said tube and comprising wings and a rib base between them and where said ribs are attached to said tube at their rib base. According to the invention at least one of said wings of each ribs comprises patterns interrupting the continuity of the wing material and/or bent surfaces making an acute angle to a plane perpendicular to the axis of said tube. The heat conducting material folded to a concertina-like shape is preferably a metal strip, but can also be e.g. a deformed wire on which sections of a cross-section corresponding to ribs are formed.

In an advantageous embodiment of the heat exchanger according to the invention each of said ribs has at the end of its wings connecting parts, each of them joined to an adjacent rib and at least one of said connecting parts is twisted at an acute angle as compared to the rib base. According to a further embodiment, both connecting parts are twisted at an acute angle of same magnitude but of opposite direction with respect to the rib base.

According to another embodiment, the ribs are bent at their rib bases attached to said tube at an acute angle with respect to a plane perpendicular to the tube axis. This embodiment results in a one-way bending of the whole ribbing.

The bending of the ribs is facilitated in an embodiment, where each of said ribs has at the end of its wings connecting parts, each of them joined to an adjacent rib and provided with a first cutout, and the part of each rib above the first cutouts is bent at an acute angle as compared to a plane perpendicular to the axis of the tube. Preferably each of the ribs is provided with a second cutout on a side of its rib base, the side being opposite to the tube, and the parts of the wings above said first cutouts being bent at an opposite direction as compared to a plane perpendicular to the axis of said tube.

According to a further advantageous embodiment, said patterns are formed by embossings made on said wings.

In another embodiment of the heat exchanger each of said ribs has at the end of its wings connecting parts, each of them joined to an adjacent rib, and said patterns are formed by third cutouts beginning in said connecting parts and extending towards the rib base lengthwise along said wings.

According to a further embodiment, the patterns are formed by holes and/or outpressed parts improving the heat exchange by interrupting the wing material.

In an advantageous embodiment of the heat exchanger, said ribs are welded through outfolds formed at the rib base to said tube having a round cross-section, and said outfolds have a form fitting to the tube in a peripheral range of at least 60°. Such a joining ensures good heat transfer and resistance.

In another highly advantageous embodiment of the heat exchanger according to the invention, two ribbings made of a folded material are attached to the tube on opposite sides thereof, and the two ribbings have ribs comprising wings with a surface bent in an opposite direction as compared to each other. Expediently, openings are formed on the opposingly bent wings of the ribbings.

The invention further relates to a method of making a heat exchanger with ribs. One method according to the invention comprises the steps of forming ribs by folding a strip of a heat conducting material to a concertina-like shape and attaching the ribs of the folded material to a tube transversally, where before the folding cutouts, holes and/or outpressed parts are formed on parts of the strip corresponding to the ribs; and/or after having attached the ribs to the tube at least a part of the surface of the ribs is bent as compared to a plane perpendicular to the axis of the tube.

Another method according to the invention comprises the steps of forming sections of a cross-section corresponding to ribs by continuous or intermittent deformation of a wire of a heat conducting material, folding the deformed wire to a concertina-like shape and, having been folded, attaching the sections to a tube transversally, where before the folding cutouts, holes and/or outpressed parts are formed on said sections of a cross-section corresponding to ribs; and/or after having attached the sections of a cross-section corresponding to ribs to the tube, at least a part of the surface of the sections is bent as compared to a plane perpendicular to the axis of said tube.

The above mentioned two procedures, forming of cutouts, holes and/or outpressed parts on the one hand and bending on the other, can be applied jointly as well.

In an advantageous embodiment of the method said attaching is performed by welding.

In a further expedient embodiment of the method according to the invention, before the folding semi-circular outfolds are formed on the edge of the middle part of said ribs or sections, said ribs or sections are attached to the tube by spot-welding said outfolds.

Cutouts, outpressed parts or embossings can continuously be made on the ribbing of the heat exchanger according to the invention, e.g. before folding and welding it to the tube, with a simple press die by a technology known per se. These then will not disturb the further procedures such as folding to a concertina-like shape and welding. In a case when bending procedures are carried out after having welded said ribbing to the tube, the welding head can easily enter among the still unbent straight ribs, and this makes closed-spaced ribbing possible, which is advantageous from the point of view of heat engineering.

By the help of the solution according to the invention, the very effective continuous method of making ribbed tubes—what is one of the most economical methods of producing heat exchangers with welded transversal ribbing—can be made suitable for the production of heat exchangers of which it is sufficient to build in 30 to 50% less than of known types for solving the same heat.

BRIEF DESCRIPTION OF THE DRAWING

The invention will be hereinafter described on basis of advantageous embodiments as shown in the drawing, wherein.

SPECIFIC DESCRIPTION

Figure 1:
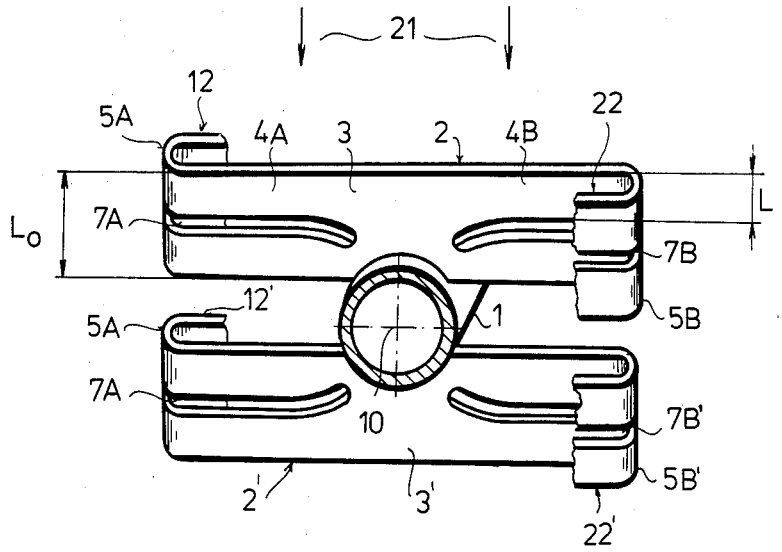
FIG. 1 is a perspective detail view of an embodiment of the heat exchanger according to the invention.

Identical elements—or those with an identical function—are indicated by identical reference signs in the figures. In FIG. 1 two ribbings folded to a concertina-like shape are attached to a tube 1, from the ribs of which only ribs 12, 2, 22 and 12', 2', 22' can be seen in the drawing. The ribs of both ribbings are placed along the axis 10 of the tube 1 nearly parallel and in front of each other. The rib 2 has two wings 4A and 4B and a rib base 3 between them. The rib 2 is joined to the two adjacent ribs 12 and 22 with connecting parts 5A and 5B at the end of said wings 4A and 4B. Similarly, rib 2' is joined to adjacent ribs 12' and 22' with connecting parts 5A' and 5B'. The ribs 2 and 2' are welded to the tube 1 at the rib base 3 and 3' respectively. Ribs 2 and 2' are substantially perpendicular to the axis 10 of the tube 1. The direction of flow of the medium, shown by arrows 21, is nearly parallel with the plane of ribs 2 and 2'. According to the invention, cutouts 7A and 7B are formed in the connecting parts 5A and 5B, extending along the wings 4A and 4B towards the rib base 3 parallel with the edges of the wings 4A and 4B, then slightly descending in order to ensure favourable heat conducting conditions in the rib 2. The rib 2' has similar cutouts 7A' and 7B', but here the cutouts 7A' and 7B' go ascending when getting nearer to the tube 1. The dimension of the rib 2 in the direction of the flow would be $L_o$ without cutouts 7A and 7B. When taking said cutouts 7A and 7B into consideration, this dimension is L, which is smaller than the half of the dimension $L_o$. According to our measurings, cutouts 7A and 7B applied in case of a flow velocity of 2 to 10 m/sec and a dimension $L_o$ of 1 to 3 centimeters result in an 30 to 50% improvement of the heat transfer.

Figure 2:
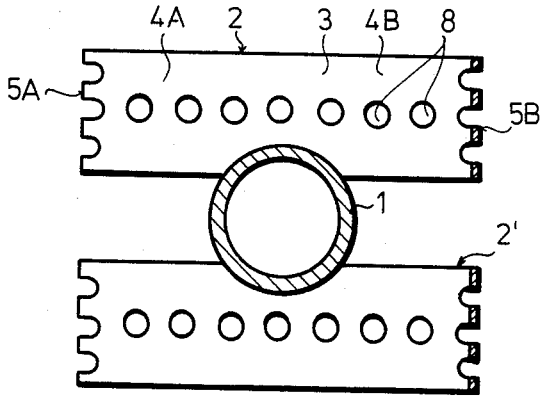
FIGS. 2 and 3 are sectional views of two further embodiments.

In FIG. 2 a line of holes 8 is formed in the middle of the rib 2. Connecting parts 5A and 5B are perforated by cutouts in order to ensure a better flexibility. The rib 2' is formed in a similar way. Here the boundary layer formed on the rib wings 4A and 4B is interrupted by the holes 8.

In this embodiment the heat transfer will not improve to such an extent as in the embodiment according to FIG. 1, nevertheless it can be rather advantageous in many cases because of the simplicity of the perforating procedure and because the smaller pressure drop occuring on the ribs.

Figure 3:
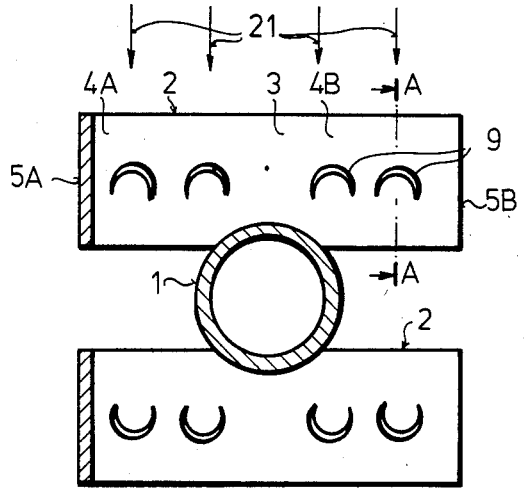
Figure 4:
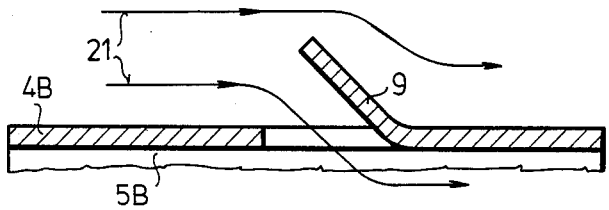
FIG. 4 is a sectional view taken along the line A—A in FIG. 3.

In FIG. 3 the rib 2 is provided with outpressed parts 9, as it can be seen in FIG. 4, which "redirect" the flow medium according to arrows 21 through the openings formed at said outpressed parts 9. Here the outpressed parts 9 function also as a heat transmitting surface. This solution is, from the point of view of heat engineering, highly advantageous, and can be applied mainly in cases where the flow medium does not tend to form a deposit.

Figure 5:
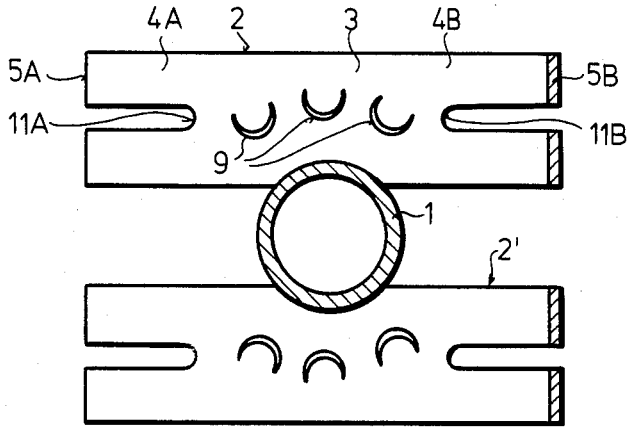
FIG. 5 is a sectional view of a further embodiment.

According to the embodiment shown in FIG. 5, three outpressed parts 9 are formed around the rib base 3 beside cutouts 11A and 11B applied on connecting parts 5A and 5B and extending along wings 4A and 4B inwards. These outpressed parts 9 can be the same as those shown in FIG. 4. In this case the heat transfer of the wings 4A and 4B is improved by said cutouts 11A and 11B, while that of the surfaces near the tube 1 is improved by said outpressed parts 9. The latters ensure at the same time the flushing of dead areas formed behind the tube 1, making thereby the formation of a slack medium area impossible.

Figure 6:
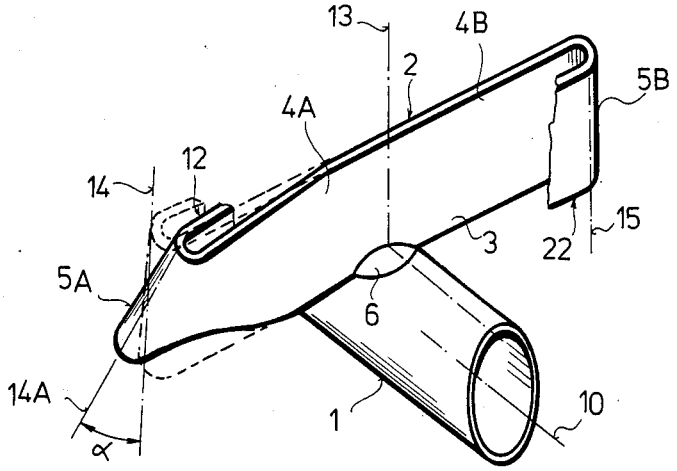
FIGS. 6 and 7 are perspective detail views of two further embodiments.

FIG. 6 illustrates an embodiment provided with bent ribs 12, 2 and 22. The unbent position of the rib 2 is shown by a dotted line. A generatrix 13 at the rib base 3 and an other generatrix 15 at the connecting part 5B of the rib 2 are perpendicular to the axis 10 of the tube 1. The generatrix 14A of the connecting part 5A is twisted at an acute angle $\alpha$ as compared to the vertical generatrix 14. Thus the wing 4A has a surface twisted and bent at the same time. The ribs 12 and 22 behind and before said rib 2, respectively, as well as the other ribs not shown in the drawing are, of course, bent in a similar way.

The embodiment shown in FIG. 6 can be realized in a form, too where the wing 4B is also twisted at the connecting part 5B, in an expedient case, at an acute angle $\alpha$ as compared to the vertical generatrix 15 in a direction opposite to that of the generatrix 14A. Nevertheless there may be another embodiment where the angles of twisting are not identical or where the direction of twisting is the same at both wings 4A and 4B. By the help of these different bendings the heat exchanger can be applied to special conditions of given places achieving thus e.g. the turning away of the medium stream.

It is especially advantageous if the angles of twisting mentioned in the previous paragraph are of an opposite direction, i.e. the two wings 4A and 4B of one and the same rib 2 are twisted in opposite directions and, at the same time, the direction of twisting of the wings belonging to the rib 2' (not shown in FIG. 6) attached to the other side of the tube 1 is opposite to the direction of twisting of the wings 4A and 4B. In this case the wings of the ribs attached to the tube 1 on the side of the incoming flow medium will direct the flow medium into two directions, while the wings of the ribs attached to the tube 1 on the other side will return the flow medium again. This embodiment has special advantages with regard to its installation because of the symmetry of the heat exchanger.

Figure 7:
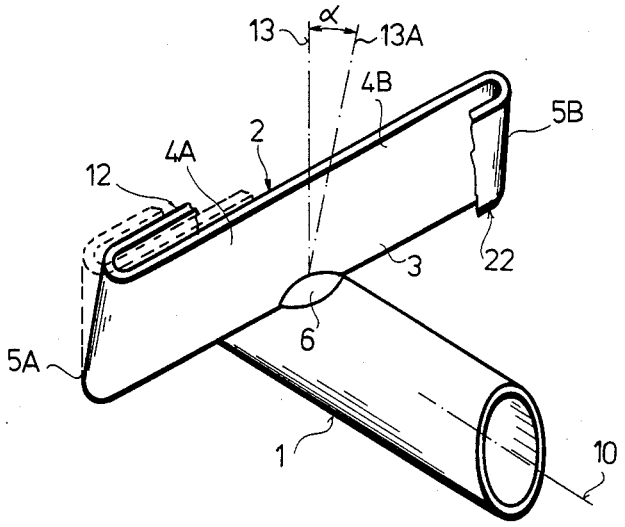

From the point of view of manufacturing technology, it is advantageous if the whole rib 2 is bent in a single step by bending its part at the rib base 3 welded to the tube 1. Such an embodiment is shown in FIG. 7, where generatrix 13A of the middle part of said rib 2 near to the rib base 3 is bent at an acute angle $\alpha$ as compared to generatrix 13 perpendicular to the axis 10 of the tube 1, so that the whole rib 2 is bent in a nearly acute angle $\alpha$ as compared to a plane perpendicular to the axis 10.

Figure 8:
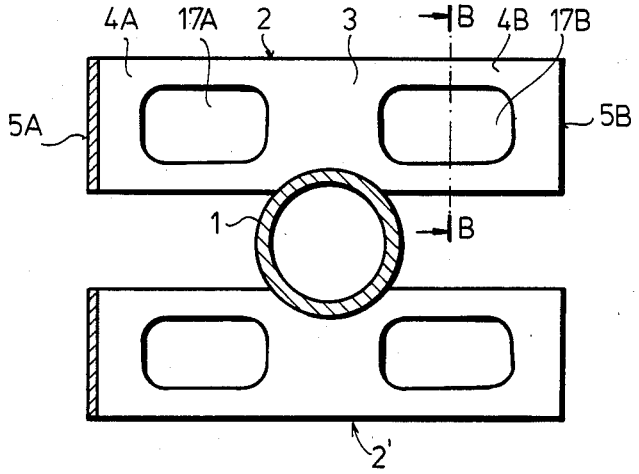
FIG. 8 is a sectional view of a further embodiment.
Figure 9:
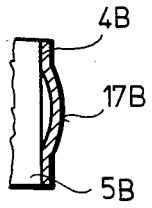
FIG. 9 is a sectional view taken along the line B—B in FIG. 8, FIGS. 10, 11 and 12 are perspective detail views of three further embodiments.

From the point of view of hydrodynamics, it is advantageous to form patterns on the surface of the wings 4A and 4B of the rib 2, preferably before the folding, by making embossings 17A and 17B as shown in FIGS. 8 and 9.

Figure 10:
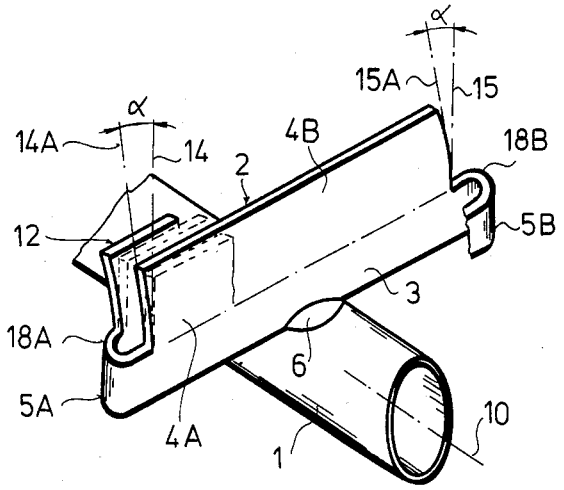

FIG. 10 shows an embodiment in which the connecting parts 5A and 5B between the rib 2 and the adjacent ribs (of which only the rib 12 can be seen in the drawing) are provided with half-side cutouts 18A and 18B, where said cutouts 18A and 18B make, at the same time, the folding to a concertina-like shape easier. In this case the bending of the upper part of the rib 2 can be carried out even after having welded the strip folded to a concertina-like shape to the tube 1. The position of the ribs 2 and 12 before their bending is shown by a dotted line; and generatrices 14A and 15A of the bent wings 4A and 4B make an acute angle $\alpha$ to generatrices 14 and 15 previous to the bending, respectively.

Figure 11:
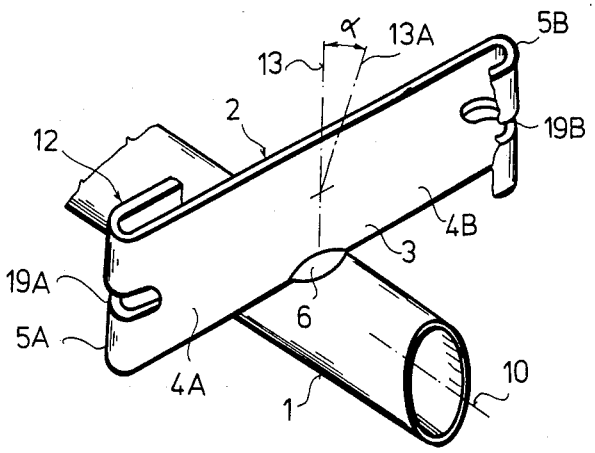

FIG. 11 shows an embodiment where the cutouts 19A and 19B in the connecting parts 5A and 5B can be found only in the middle for increasing the mechanical strength of the ribbing. In case of such an embodiment, the part of the rib 2 above cutouts 19A and 19B can easily be bent at an acute angle $\alpha$ as compared to a plane perpendicular to the axis 10 of the tube 1. FIG. 11 shows the rib 2 in an unbent position; its bent position is marked by generatrix 13A which stands in an acute angle $\alpha$ as compared to generatrix 13 of the still unbent rib 2.

Figure 12:
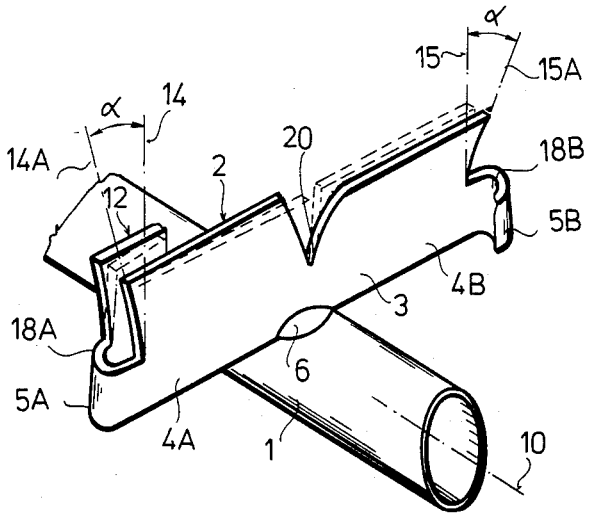

It may be advantageous if the embodiment shown in FIG. 10 is modified in a way that the wings 4A and 4B are bent at an opposite direction as compared to each other. Such an embodiment is shown in FIG. 12, here a further cutout 20 is formed in the middle part between the wings 4A and 4B, at the rib base 3, what makes the bending of the upper parts of said wings 4A and 4B in an opposite direction easier; this bending proceeds—according to the embodiment shown here—at an identical acute angle $\alpha$. The position previous to bending is shown by a dotted line in this figure, too.

Figure 13:
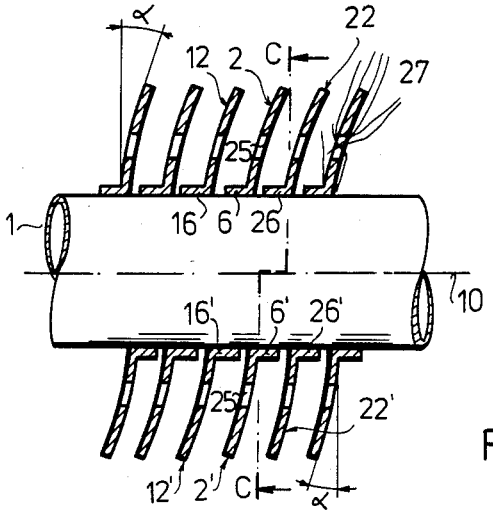
FIG. 13 is a sectional view of a further embodiment taken along the line D—D in FIG. 14.
Figure 14:
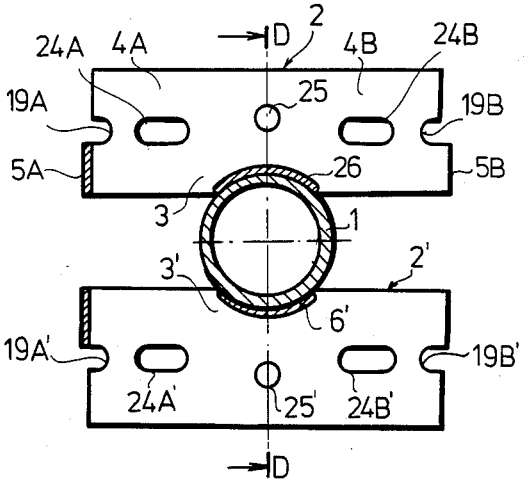
FIG. 14 is a sectional view taken along the line C—C in FIG. 13.
Figure 15:
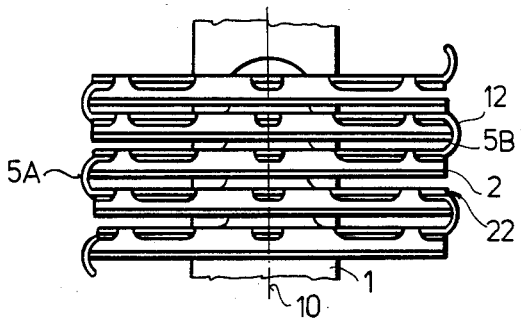
FIG. 15 is a top view of a detail of the embodiment according to FIGS. 13 and 14.

From the point of view of heat engineering and manufacturing technology, a special advantage can be achieved if cutouts, holes, outpressed parts and bendings are applied jointly as in the embodiment shown in FIGS. 13 to 15. FIG. 13 is a sectional view taken along the line D—D in FIG. 14, FIG. 14 is a sectional view taken along the line C—C in FIG. 13, and FIG. 15 is a top plan view where the ribbing attached to the lower part of the tube 1 is not shown for the sake of better visibility. In case of this embodiment the cutouts 19A and 19B applied at the connecting parts 5A and 5B of the rib 2, as well as the openings 24A and 24B in the wings 4A and 4B make the bending of the upper part of the rib 2 especially easy in case of a ribbing having been welded to the tube 1 previously. Further a hole 25 is formed in the middle part of the rib 2. Similarly, the rib 2' of the ribbing attached to the other side of the tube 1 is provided with cutouts 19A' and 19B' as well with a hole 25'. As a consequence of the bending, a pressure difference appears between the two sides of the ribs (e.g. those of the rib 2) for fluid mechanical reasons. Because of this, a flow will start through the openings 24A and 24B as well as through the hole 25 placed in the bending, what draws the boundary layer 27, thus improving heat transfer in a significant degree. It can be seen in FIG. 13 that the ribbings on the two opposite sides of the tube 1 are bent in a direction opposite to each other. The ribs 12, 2 and 22 are bent to the right at an acute angle $\alpha$ as compared with a plane perpendicular to the axis 10, while the ribs 12', 2' and 22' are bent to the left also at an acute angle $\alpha$, preferably at an angle of 20° to 25°. The ribs 12, 2 and 22 are provided with outfolds 16, 6 and 26, respectively, which fit to the tube 1 at a peripheral range of at least 60°. The ribs 12, 2 and 22 of the one ribbing can be attached to the tube 1 at the outfolds 16, 6 and 26 by point-welding. Similarly, the ribs 12', 2' and 22' of the other ribbing on the opposite side of the tube 1 are point-welded to said tube 1 at the outfolds 16', 6' and 26'.

In the shown embodiments of the heat exchanger according to the invention, the ribs are substantially parallel with each other, and their longitudinal axis is substantially perpendicular to the axis 10 of the tube 1. This is not necessarily so, there may be other embodiments where the ribbing is formed in a zigzag shape, i.e. the adjacent ribs are not parallel with each other, but there is an acute angle between them. According to a further embodiment all the ribs are parallel with each other but their longitudinal axis makes an angle to the axis 10 of the tube 1 different from 90°. From the point of view of the invention, the only essential fact is that the ribbing should be in relation to the tube a transversal ribbing. The tube can also have an other cross-section than that of a circular ring.

There can be several tubes arranged in a suitable way as compared to each other in the heat exchanger according to the invention. Each of these should be provided with a ribbing formed according to the invention. The ribbing may be only on one side of the tube or on both sides facing each other. The ribbing and the tube can be attached to each other by welding, soldering or by any other procedure known per se.

In case of the embodiments shown in the drawings, the heat conducting material folded to a concertina-like shape is a metal strip. However, this is—according to the invention—not an absolute necessity. The essential point is that the material folded to a concertina-like shape should have parts constituting wings having a cross-section of an elongated plane figure, e.g. in case of a strip a rectangle, the longitudinal axis of which is substantially perpendicular to the axis of the tube, leaving the possible bending of the wing according to the invention out of consideration. The elongated plane figure can, however, have outlines different from straight lines, e.g. two circular arcs. In this case the cross-section of the wings is shaped which is advantageous from a hydrodynamic point of view.

When producing a heat exchanger according to the invention, one can start with a heat conducting strip or wire material. It can be advantageous e.g. to apply a metal strip. In case when some wire of a given cross-section is taken as the starting material, e.g. aluminium wire of a round cross-section, the sections of a nearly rectangular cross-section corresponding to wings can be produced first by cold deformation. It is not an absolute necessity that the wire parts between these sections should also have a nearly rectangular cross-section. According to the invention cutouts, holes, embossings and/or outpressed parts are formed before the folding, while the bending of the ribs follows the attachment, preferably welding of the ribbing to the tube.

What is claimed is:

1. In a heat exchanger, a heat-exchanger element which comprises:

a tube composed of a heat-conducting material; and two ribbing strips secured to said tube in said heat-conducting relationship therewith, said strips being disposed on diametrically opposite sides of said tube, each of said strips comprising:

respective transverse portions extending across the tube and having a central portion formed with an arcuate recess receiving the tube and a pair of wings projecting laterally outwardly beyond said tube and cantilevered therefrom, each of said wings being connected to a wing of an adjacent transverse portion by connecting portions, the transverse portions having widths substantially smaller than their lengths, each of said central portions being formed with a plurality of arcuate cutouts from which portions are bent to intercept a flowing fluid, each of said wings being formed with elongated cutouts extending into the respective connecting portions and terminating at said central portions, and said strips being separated from one another across said tube by a gap approximately equal to the internal diameter of said tube.

2. A heat exchanger comprising:

at least one tube made of a heat conducting material for circulating a first fluid medium, for each tube two strip ribbings attached to said tube in heat-conducting relationship along diametrically opposite sides of said tube to increase the heat exchange between the first fluid medium and a second fluid medium passing the tube substantially parallel to surfaces of said ribbings, each of said ribbings being made of a heat conducting strip material folded to an accordion-like shape to form a plurality of spaced ribs and connecting parts connecting the adjacent ribs at alternate ends, each of said ribs comprising two wings overhanging opposite sides of said tube and a rib base between said wings, said overhanging wings of each rib being separated by a gap from the overhanging wings of the other ribbing of the respective tube, said connecting parts being joined with the ends of the wings of the adjacent ribs, each of said ribbings being attached to said tube at its rib bases along one side of said tube so that the ribs extend transversely to an axis of said tube and the two ribbings are not in direct contact with each other, each of said ribs comprising at least one discontinuity interrupting the continuity of the wing material in the direction of lines along which the ribbing is folded whereby boundary layers of the second fluid medium formed along the wing surfaces are at least partly interrupted, said discontinuity comprising a cutout beginning in the connecting part and extending lengthwise along the wing.

3. The heat exchanger according to claim 2 wherein said ribs comprise further discontinuities in the form of openings made in said wings.

4. The heat exchanger according to claim 2 wherein said ribs comprise further discontinuities in the form of outpressed parts made in said wings.

5. The heat exchanger according to claim 2 wherein said ribs are welded through outfolds formed at the rib base to said tube having a round cross-section, and said outfolds have a form fitting to said tube in a peripheral range of at least 60°.

6. The heat exchanger according to claim 2 wherein each of said ribs comprises at least one wing having bent surfaces making an acute angle with respect to a plane perpendicular to the axis of said tube.

7. The heat exchanger according to claim 6 wherein said connecting parts are narrower than said ribs in the direction of said folding lines and the part of each rib extending over the respective connecting parts is bent at an acute angle with respect to a plane perpendicular to the axis of said tube.

8. The heat exchanger according to claim 6 wherein the ribs of said two ribbings attached to each tube have surfaces bent at an acute angle in opposite directions with respect to a plane perpendicular to the axis of said tube.

9. The heat exchanger according to claim 8 wherein said ribs comprise further discontinuities in the form of openings.

* * * * *